US007708538B2

(12) United States Patent
Kawabata et al.

(10) Patent No.: US 7,708,538 B2
(45) Date of Patent: May 4, 2010

(54) OIL FREE SCREW COMPRESSOR

(75) Inventors: Natsuki Kawabata, Shizuoka (JP); Hitoshi Nishimura, Shizuoka (JP); Yusuke Nagai, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 11/779,910

(22) Filed: Jul. 19, 2007

(65) Prior Publication Data

US 2008/0050257 A1 Feb. 28, 2008

(30) Foreign Application Priority Data

Jul. 19, 2006 (JP) ..... 2006-196410

(51) Int. Cl.
*F01C 21/04* (2006.01)
*F01C 21/06* (2006.01)
*F03C 2/00* (2006.01)

(52) U.S. Cl. ..... 418/83; 418/9; 418/88; 418/201.1; 417/313; 417/243; 417/244

(58) Field of Classification Search ..... 418/9, 418/83, 88, 97–99, 201.1, 206.1; 417/243, 417/244, 313, 363, 410.3, 410.4
See application file for complete search history.

(56) References Cited

U.S. PATENT DOCUMENTS 5,263,832 A 11/1993 Yamaguchi
5,401,149 A * 3/1995 Tsuru et al. ..... 418/201.1
6,210,132 B1 * 4/2001 Shiinoki et al. ..... 418/101
6,551,082 B2 * 4/2003 Douzono et al. ..... 418/201.1
6,572,350 B2 * 6/2003 Takahashi et al. ..... 418/9
2006/0280626 A1 * 12/2006 Nishimura et al. ..... 417/410.4

FOREIGN PATENT DOCUMENTS

CN 1648458 8/2005
JP 03151592 A * 6/1991 ..... 418/9
JP 11-141488 5/1999
JP 2002-155879 5/2002
JP 2005207370 A * 8/2005

* cited by examiner

*Primary Examiner*—Theresa Trieu
(74) *Attorney, Agent, or Firm*—Antonelli, Terry, Stout & Kraus, LLP.

(57) ABSTRACT

The invention downsizes and simplifies structures of a compressor and its driving system apparatus, and achieves a reduction of a noise. An oil free screw compressor is constituted by compressor main bodies compressing a gas, a motor driving rotors of the compressor main bodies via step-up gears, a gear casing storing the step-up gears, cooling apparatuses cooling a discharge air and the like. An oil tank is provided independently from the gear casing, the motor is fixed to a common base, the gear casing is integrally attached to the motor via a flange, and the compressor main bodies are integrally attached to the gear casing via the flange. Further, the cooling apparatuses are arranged in an upper side of the driving system apparatus, and a cooling fan is installed in an upper side thereof.

8 Claims, 2 Drawing Sheets

OIL FREE SCREW COMPRESSOR

INCORPORATION BY REFERENCE

The present application claims priority from Japanese application JP2006-196410 filed on Jul. 19, 2006, the content of which is hereby incorporated by reference into this application.

BACKGROUND OF THE INVENTION

1. Field of the Invention

The present invention relates to an oil free screw compressor having a compressor airend compressing a gas such as an air or the like, a driving apparatus driving the compressor airend, a cooling device cooling the gas discharged from the compressor airend and the like, and is particularly suitable for a middle capacity package type oil free screw compressor provided with a low pressure stage compressor airend and a high pressure stage compressor airend.

2. Description of Related Art

As one example of the conventional middle capacity oil free screw compressor, there is a structure described in patent document 1 (JP-A-2002-155879 (FIG. 1)). In this conventional structure, a gear shaft within a gear casing and a motor shaft driving the gear shaft are coupled by using a coupling. Further, generally, the motor and the gear casing are both fixed to a driving system special purpose base fixed to a common base, and cooling devices such as an air-cooled cooler (an after cooler, an inter cooler, an oil cooler or the like) and the like is arranged in a back surface of the compression main body or a driving system apparatus (a motor, a gear casing or the like). The cooler constructing the cooling device is arranged so as to be exposed to a back surface of a package, and is structured such as to directly take a low-temperature ambient air into the cooler, thereby achieving a downsizing.

Further, such as a prior art described in patent document 2 (JP-A-11-141488 (FIGS. 2 to 8), there has been known a structure in which the inter cooler, the after cooler, the oil cooler or the like is arranged in one side which is isolated from the compression main body and the driving system apparatus within the package, the motor and the compressor airend are fixed to the gear casing, and the gear casing is fixed to the base.

In both of the conventional oil free screw compressors, since the structure is made such that the gear casing and the motor are fastened by using the coupling, and the motor and the gear casing are both provided with the driving system special purpose base fixed to the common base, and are fixed thereto, it takes a lot of trouble to regulate so as to center the coupling, and a unit length is elongated. Further, there is a disadvantage that the driving system special purpose base, the gear shaft, the gear shaft bearing and the like are necessary.

Since the gear casing doubles as a function of an oil reservoir, the gear casing is enlarged in size, so that there is a problem that a high cost is involved by a necessity of a great working equipment. Further, since the gear casing is large, it is known that the gear casing itself is vibrated like a drum so as to form a noise source.

Further, in the package-shaped oil free screw compressor or the like, since the structured is generally made such that the device such as the cooler or the like constructing the cooling apparatus is exposed to a back surface of the package, or is directly communicated, there is a disadvantage that a vibration sound or a pulsation sound tends to leak to an outer side of the package from a surface of the cooler portion.

BRIEF SUMMARY OF THE INVENTION

An object of the present invention is to obtain an oil free screw compressor which can downsize a gear casing as well as improving an assembling characteristic of a compressor and a driving system apparatus.

The other object of the present invention is to obtain an oil free screw compressor which can intend to achieve a low noise.

Further the other object of the present invention is to obtain an oil free screw compressor which can efficiently supply a cooling air to a cooling apparatus.

In order to achieve the object, in accordance with a first aspect of the present invention, there is provided an oil free screw compressor comprising:

a compressor airend having a rotor and compressing a gas;

a step-up gear connected to the rotor of the compressor airend;

a gear casing accommodating the step-up gear; and a motor driving the rotor of the compressor airend via the step-up gear, wherein an oil tank reserving a lubricating oil lubricating the step-up gear within the gear casing is provided as an independent body from the gear casing, the motor is fixed to the base, the gear casing is integrally fixed to the motor, and the compressor airend is integrally fixed to the gear casing.

In this case, the structure may be made such that the gear casing is fixed to the motor via a flange, the compressor airend is fixed to the gear casing via a flange, the motor is provided with a leg portion for fixing to the base, and the motor, the gear casing and the compressor airend are attached to the base by fixing the leg portion to the base.

Further, the structure may be made such that the step-up gear has a bull gear fixed to a motor shaft of the motor, and a pinion gear fixed to a rotor shaft of the compressor airend and engaging with the bull gear.

Further, it is preferable the structure is made such that a leg portion is provided in the gear casing, and the gear casing is supported to the base via the leg portion provided in the gear casing in the case that the motor and the gear casing are in a separated state.

The compressor airend can be applied to a structure constructed by two compressor main bodies comprising a low pressure stage compressor airend boosting the gas from an intake pressure to an intermediate pressure, and a high pressure stage compressor airend boosting the gas from the intermediate pressure to a discharge pressure.

It is preferable in the light of a maintenance if the oil tank is installed in a base (a common base) common with the base fixing the motor, and an oil gauge is attached to the oil tank.

In accordance with a second aspect of the present invention, there is provided a package type oil free screw compressor comprising:

a low pressure stage compressor airend;

a high pressure stage compressor airend;

a gear casing having a step-up gear;

a driving apparatus for driving each of the compressor main bodies via the step-up gear;

a low pressure stage cooling system apparatus cooling a compression gas discharged from the low pressure stage compressor airend;

a high pressure stage cooling apparatus cooling a compression gas discharged from the high pressure stage compressor airend;

a lubricating oil cooling apparatus cooling a lubricating oil lubricating the step-up gear; and a whole of the devices being packaged, wherein the low pressure stage compressor airend, the high pressure stage compressor airend and the driving apparatus are integrated, the driving apparatus is installed in a base common with a base installing the other devices, at least one of the low pressure stage cooling system apparatus, the high pressure stage cooling apparatus and the lubricating oil cooling apparatus is arranged in an upper portion of the package, an intake duct sucking an ambient air is arranged in one side surface of the package, and the intake duct supports at least one end of the cooling apparatus arranged in an upper portion of the package.

In this case, the structure may be made such that the oil tank reserving the lubricating oil for lubricating the step-up gear within the gear casing is provided as an independent body from the gear casing, and the oil tank is installed in the common base fixing the driving apparatus.

Further, it is preferable that the structure is made such that the low pressure stage cooling apparatus, the high pressure stage cooling apparatus and the lubricating oil cooling apparatus are arranged in the upper portion of the package, the low pressure stage cooling apparatus is arranged in an upper portion which is adjacent to the low pressure stage compressor airend, the high pressure stage cooling apparatus is arranged in an upper portion which is adjacent to the high pressure stage compressor airend, a cooling air cooling the low temperature side of the cooling apparatus comes to a lower temperature than a cooling air cooling the high temperature side, in at least any of the cooling apparatuses.

In this case, the structure may be made such that at least one of the low pressure stage cooling apparatus, the high pressure stage cooling apparatus and the lubricating oil cooling apparatus is arranged so as to be somewhat inclined with respect to the common base.

If the structure is made such that the intake duct is provided with an air inflow port formed in a lower portion of an outer side surface and communicating the ambient air with an inner side of the duct, and an air outflow port formed in an upper portion of an inner side surface of the duct, and introducing the air taken into the duct from the air inflow port into an inner side of the package, and the air inflow port and the air outflow port are arranged in such a manner as not to overlap in a horizontal direction, it is possible to reduce a leakage of a noise within the package out of the package.

Further, if the structure is made such that a start plate for starting the driving apparatus, and a drier for removing a water content in the compression gas are installed on the base within the package, the driving apparatus is arranged so as to be sandwiched between the start plate and the drier, and the ambient air introduced into the package from one side surface of the package cools the driving apparatus at a time of passing through a portion between the start plate and the drier, there is obtained an effect that it is possible to efficiently cool the driving apparatus as well as it is possible to package compact as a whole.

In accordance with the present invention, since the structure is made such that the gear casing is integrally fixed to the motor, it is possible to improve an assembling characteristic of the driving system apparatus driving the compressor. Particularly, since the bull gear of the step-up gear is directly fixed to the motor shaft, the coupling is not required, and the assembling characteristic is improved.

Further, since the oil tank reserving the lubricating oil for lubricating the step-up gear is provided as the independent body from the gear casing, it is not necessary to reserve the lubricating oil within the gear casing, and it is possible to widely downsize the gear casing. Accordingly, it is possible to integrally attach the gear casing to the motor, it is sufficient to fix only the motor to the base by integrally attaching the compressor airend to the gear casing, and it is not necessary to fix the gear casing to the base as is different from the conventional structure.

Further, since the gear casing can be widely downsized, it is possible to prevent the gear casing from deforming like the drum, and it is possible to achieve the low noise.

Further, since the structure is made such that the cooler (the cooling apparatus) is arranged in the upper portion of the package, preferably approximately in parallel to the base, it is possible to reduce the noise leaking from the cooler portion in the horizontal direction, in comparison with the case that the cooler is provided in the package side surface. Further, since the structure is made such that the intake duct sucking the ambient air is arranged in one side surface of the package, and the intake duct supports at least one end of the cooling apparatus arranged in the upper portion of the package, the structure is simplified, and there is obtained an effect that it is possible to reduce the leakage of the noise to the external portion by the intake duct while efficiently supplying the cooling air to the cooling apparatus.

A description will be given below of features of the best mode of the present invention.

The compressor is structured as the two-stage screw compressor having the low pressure stage compressor airend and the high pressure stage compressor airend compressing the gas such as the air or the like by rotating the screw rotor. Further, the driving system apparatus is constituted by the motor (the driving apparatus) serving as a power source for the compressor airend executing a compressing work, the step-up gear increasing the speed of the rotation of the motor so as to transmit the rotation to the compressor rotor, the gear casing storing the step-up gear and the like.

In the driving system apparatus mentioned above, the structure is made such that the gear casing is downsized by setting the oil tank which is independently placed from the gear casing, the motor is attached to the common base of the compressor package unit, the gear casing is connected to the motor via the flange, and the compressor airend is connected to the gear casing via the flange. In accordance with this structure, it is possible to do away with the coupling between the motor and the step-up gear. Accordingly, it is possible to directly attach the step-up gear to the motor shaft, and it is possible to do away with the gear shaft and the bearing in the conventional structure. Further, the oil gauge is provided in the oil tank which is separated from the gear casing. Since it is necessary to independently detach the motor at a time of maintaining the motor, the leg portion is provided in the gear casing, and the structure is made such that the gear casing itself can be directly fixed to the common base.

In the upper portion of the compressor within the compressor package unit and the driving system apparatus of the compressor, there are arranged the low pressure stage cooling apparatus (the inter cooler) cooling the gas such as the air or the like discharged from the low pressure stage compressor airend and discharging an exhaust heat out of the apparatus, the high pressure stage cooling apparatus (the after cooler) cooling the gas such as the air or the like discharged from the high pressure stage compressor airend and discharging the exhaust heat out of the apparatus, and the oil cooling apparatus (the oil cooler) for cooling the lubricating oil of the step-up gear or the like, in such a manner as to be in parallel to the common base in the unit bottom portion fixing the motor, or be inclined.

The following effects can be obtained by employing the structure mentioned above.

Since the compressor and the driving system apparatus are integrated, it is possible to downsize, it is possible to reduce the installation space of the driving system apparatus, and it is possible to improve a layout freedom of the cooler, the pump or the like installed within the unit. Further, since the coupling of the motor and the gear shaft becomes unnecessary, it is possible to do away with the centering regulation work, and since the bearing for the gear shaft becomes unnecessary, it is easy to execute the maintenance. Further, the special purpose base for the driving system apparatus becomes unnecessary by integrating the compressor and the driving system thereof, the special purpose base being conventionally necessary.

Since the structure is made such that the leg portion is provided in the gear casing, and the gear casing itself is fixed to the common base, it is possible to independently maintain the motor.

Since the oil tank is provided independently from the gear casing, the gear casing is downsized and becomes advantageous in the light of the cost, and in the case that it is formed by a casting, it is possible to achieve an improvement of a yield ratio on the basis of an improvement of a casting characteristic, and it is possible to prevent the gear casing from deforming like the drum so as to form a generating source of a great noise. Further, since the oil gauge is attached to the oil tank which is independently provided from the gear casing, it becomes easily possible to arrange the oil gauge at a position where a compressor manager and a maintenance worker easily check.

Since each of the coolers is arranged in the upper portion within the unit, the structure can be made such that the cooler is not exposed to the ambient air, and it is possible to reduce the sound leakage from the cooler portion. Further, since the structure is made such that the cooling air cooling the low temperature side of the cooling apparatus comes to the lower temperature than the cooling air cooling the high temperature side, in at least any of the cooling apparatuses, it is possible to execute an efficient heat exchange. For example, the structure is made such as to directly introduce the cooling air having a comparatively higher temperature after cooling the motor to the inflow side (the high temperature side) of the compression gas in the high pressure stage cooling apparatus and the low pressure stage cooling apparatus, and directly introduce the cooling air taking in the ambient air having the low temperature via the intake duct to the outflow side (the low temperature side) of the compression gas. Further, since the low pressure stage cooling apparatus is arranged so as to be adjacent to the low pressure stage compressor airend, and the high pressure stage cooling apparatus is arranged so as to be adjacent to the high pressure stage compressor airend, it is possible to shorten a piping route coupling the compressor airend and the cooling device, and it is possible to achieve a simplification of a piping system.

In the case that each of the coolers is arranged so as to be inclined with respect to the common base in the bottom portion of the compressor unit in place of being in parallel, it is possible to execute the more effective heat exchange. Further, since one end side of each of the coolers is supported by the intake duct, it is possible to reduce the frame member for supporting the cooler.

Other objects, features and advantages of the invention will become apparent from the following description of the embodiments of the invention taken in conjunction with the accompanying drawings.

DETAILED DESCRIPTION OF THE INVENTION

A description will be given below of a specific embodiment in accordance with the present invention on the basis of the accompanying drawings.

Embodiment 1

Figure 1:
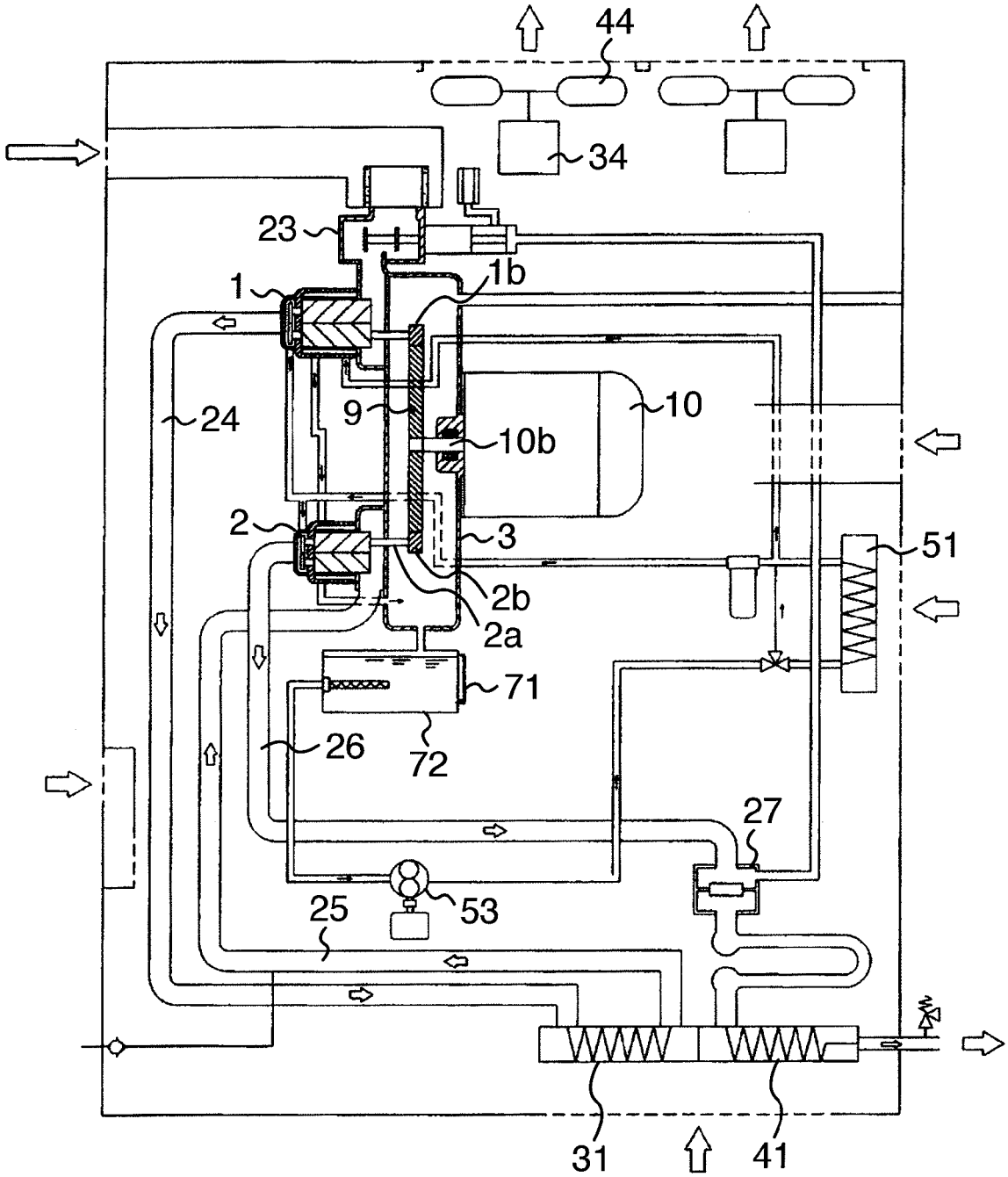
FIG. 1 is a system view explaining a whole structure of an oil free screw compressor showing an embodiment in accordance with the present invention.

FIG. 1 is a system view showing a whole structure of an oil free screw compressor in accordance with the present embodiment, and shows an example in the case of applying the present invention to an air-cooled type two-stage oil free screw compressor.

The air-cooled type two-stage oil free screw compressor is provided with a low pressure stage side compressor airend 1 and a high pressure stage side compressor airend 2, and these compressor main bodies 1 and 2 are coupled to a motor shaft 10*a* of a motor 10. A gear casing 3 is provided with a bull gear 9 attached to a shaft leading end of the motor shaft 10*a*, and pinion gears 1*b* and 2*b* attached to leading ends of rotation driven shafts 1*a* and 2*a* of the compressor main bodies 1 and 2 and engaging with the bull gear 9. When the motor 10 is rotated, a rotating force thereof is transmitted to the compressor main bodies 1 and 2 via the bull gear 9 and the pinion gears 1*b* and 2*b* so as to rotate the compressor main bodies 1 and 2 and compress an air for compression.

An inter cooler (a low pressure stage cooling apparatus) 31 is connected to a discharge side of the low pressure stage side compressor airend 1 via a low pressure stage side discharge piping 24, and the inter cooler 31 is connected to an intake side of the high pressure stage side compressor airend 2 via a high pressure stage side intake piping 25. Further, an after cooler (a high pressure stage cooling apparatus) 41 is connected to a discharge side of the high pressure stage side compressor airend 2 via a high pressure stage side discharge piping 26 and a check valve 27. A cooling air is supplied to the inter cooler 31 and the after cooler 41 by a cooling fan 44 connected to a fan motor 34, and cools a compressed air compressed by the low pressure stage side compressor airend 1 and the high pressure stage side compressor airend 2 so as to come to a high temperature. An oil cooler (a lubricating oil cooling apparatus) 51 cools a lubricating oil circulating by an oil pump 53 and lubricating a gear and a bearing.

In the present embodiment, the gear casing 3 is downsized by independently setting an oil tank 72 so as to be separated from the gear casing 3, and the gear casing 3 is connected to the motor 10 via a flange. The bull gear 9 is attached to the motor shaft 10*a* of the motor 10, and the motor 10 is rotated, whereby the rotating force thereof is transmitted to the compressor main bodies 1 and 2 via the bull gear 9 and the pinion gears 1*b* and 2*b*, and the air is compressed by rotating the compressor main bodies.

Figure 2:
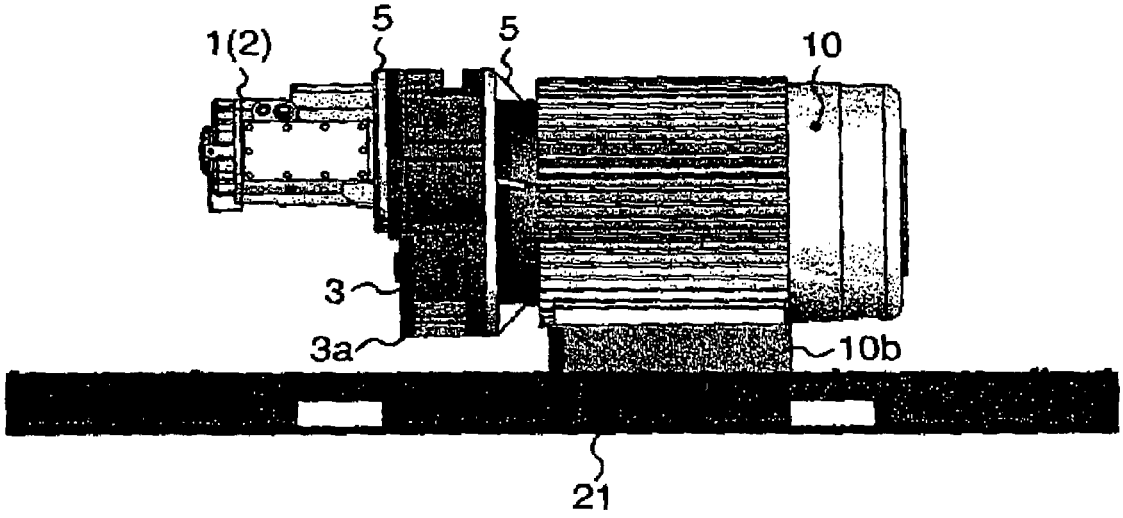
FIG. 2 is a front elevational view showing a compressor and a driving system apparatus in an embodiment in accordance with the present invention.

FIG. 2 is a front elevational view showing an embodiment in accordance with the present invention showing a structure of the compressor and its driving system. Conventionally, the motor 10 is fastened to a gear shaft via a coupling, and the low pressure stage and high pressure stage side compressor main bodies are connected to the gear casing 3 by the flange. Further, the structure is conventionally made such that the motor 10 and the gear casing 3 are fixed onto the driving system special purpose base, and the driving system special purpose base is attached to the common base 21 generally installing the other devices via a vibration proof rubber. In this case, the gear casing is also provided with the oil gauge for visually observing the oil amount.

On the contrary, in accordance with the present embodiment, since the oil tank 72 (refer to FIG. 1) is independently provided, as shown in FIG. 2, it is possible to downsize the gear casing 3, and the gear casing 3 is connected and fixed to the motor 10 fixed to the common base 21 via the leg portion 10*b*, via a flange 5. Further, the compressor main bodies 1 and 2 (refer to FIG. 1 in the high pressure stage side compressor airend 2) is connected and fixed to the gear casing 3 via the flange 5. In this case, the leg portion 3*a* is provided in the gear casing 3 in such a manner that it is possible to disconnect the gear casing 3 from the motor 10 so as to be installed at a time of maintaining the motor 10. Accordingly, since the motor can be independently fixed to the common base 21, it is possible to easily execute a maintenance work.

In accordance with the present embodiment mentioned above, since it is not necessary to fix the gear casing 3 to the common base 21, and it becomes sufficient to fix the compressor and its driving system to common base 21 only via the leg portion 10*b* of the motor, it is not necessary to use the driving system special purpose base as is different from the conventional structure, and it is possible to simplify the structure. In this case, the leg portion 10*b* of the motor may be installed in the common base 21 via the vibration proof rubber. Further, in accordance with the present embodiment, since the coupling becomes unnecessary as is different from the conventional structure, it is unnecessary to execute the regulation such as the case of using the coupling, and it is possible to widely improve a productivity and a maintenance characteristic. Further, since the bull gear 9 (refer to FIG. 1) is directly attached to the motor shaft (the drive shaft) 10*a*, the gear shaft and the bearing supporting the gear shaft are unnecessary as is different from the conventional structure. Further, since the compressor and the driving system thereof are integrated, and are downsized, it is possible to increase a freedom of arranging the parts such as the inter cooler 31, the after cooler 41 and the like.

Further, since the gear casing 3 can be downsized in comparison with the prior art, it is possible to reduce a cost, it is possible to improve the productivity on the basis of an improvement of a yield ratio, and it is possible to reduce the noise caused by the vibration of the gear casing 3A surface.

Figure 3:
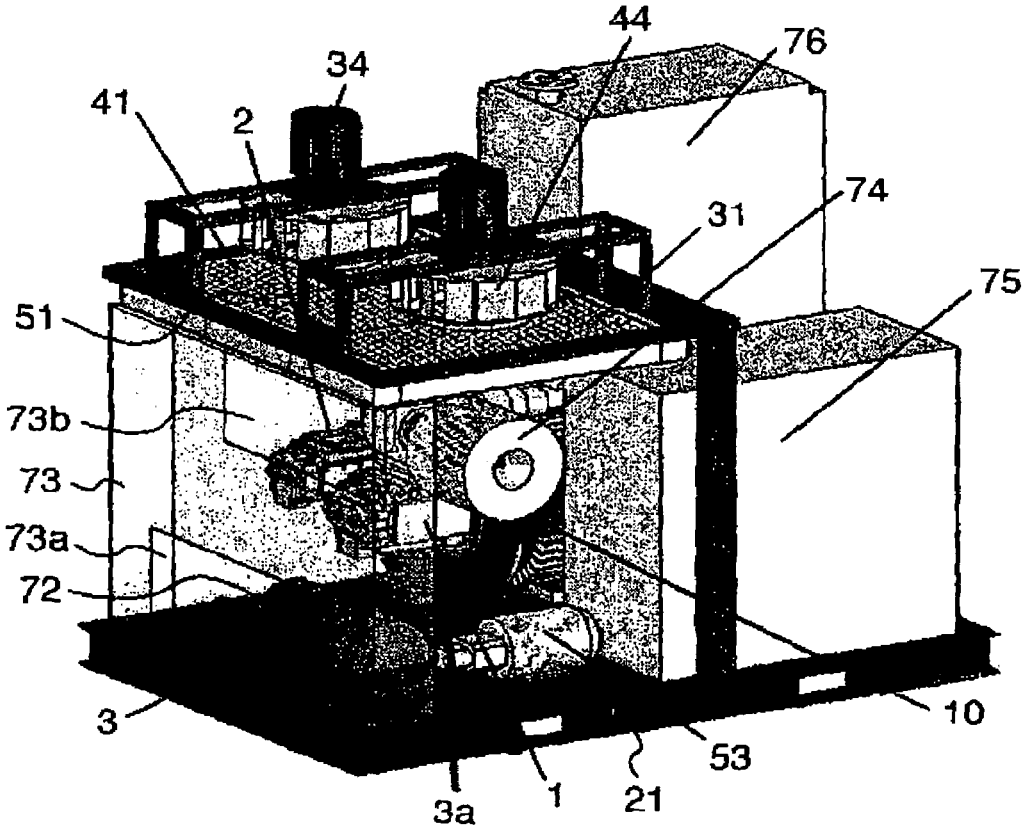
FIG. 3 is a bird's eye view showing a structure of a whole of an oil free screw compressor showing an embodiment in accordance with the present invention.

FIG. 3 is a bird's eye view of a whole of the compressor unit in the present embodiment.

Conventionally, the inter cooler 31, the after cooler 41 and the oil cooler 51 shown in FIG. 1 are arranged in a back surface of the compressor unit, and the structure is made such that the cooling air of each of the coolers is sucked while passing through each of the coolers 31, 41 and 51 from an external portion of the package, and is discharged to the external portion from an upper portion of the package by a cooling fan provided above the unit. Since the structure is generally made such that the cooling air passage surface is exposed to the external portion of the package in order to lower a pressure loss and introduce the cooling air having a temperature as low as possible to each of the coolers, there is a defect that the noise from the inner side of the unit tends to leak to the external portion. Further, in the case of arranging each of the coolers 31, 41 and 51 in the back surface of the package such as this prior art, a distance becomes elongated between the low pressure stage side compressor airend 1 and the inter cooler 31, and between the high pressure stage side compressor airend 2 and the after cooler 41, so that not only the piping structure of the discharge gas becomes complicated, but also the pipings (for example, the pipings 24, 25 and 26 in FIG. 1) become very expensive because of being made of a stainless steel.

On the contrary, in accordance with the present embodiment, the after cooler 31, the inter cooler 41 and the oil cooler 51 are arranged above the compressors 1 and 2, the driving system 10 thereof and the like, and approximately in parallel to the common base 21. In the present embodiment, since each of the coolers 31, 41 and 51 is placed below the cooling fan 44, it is possible to place each of the coolers within a cover (not shown) covering an outer side of the package type compressor unit via a space. Accordingly, each of the coolers can be structured such as not to be exposed to the external portion, and it is possible to achieve the low noise of the package type compressor unit while suppressing the sound leak from the inner portion of the unit.

Further, in the present embodiment, the after cooler 31, the inter cooler 41 and the oil cooler 51 are arranged and structured such that the cooling air cooling the low temperature side of the cooling apparatuses thereof comes to the lower temperature than the cooling air cooling the high temperature side. In other words, since the structure is made such as to directly introduce the cooling air (for example, about 40° C.) having the comparatively high temperature after cooling the motor to the inflow side (the high temperature side: for example, into which the compression gas at about 180° C. flow) of the compression gas in the high pressure stage cooling apparatus and the low pressure stage cooling apparatus, and directly introduce the ambient air (the cooling air: for example, at about 25° C.) taken in via the intake duct to the outflow side (the low temperature side: for example, to which the compression gas cooled to about 55° C. flow out) of the compression gas, it is possible to improve a cooling efficiency, and it is possible to achieve the structure having no noise leakage from the inner side of the unit. Further, since the layout of the coolers is structured by arranging the inter cooler 31 in the upper portion of the compressor (the low pressure stage side compressor airend) 1 in the front surface side of the unit, and arranging the after cooler 41 in the upper portion of the compressor (the high pressure stage side compressor airend) 2 in the back surface side of the unit, the piping route between the compressor airend and the cooler is widely shortened in comparison with the conventional structure.

The oil tank 72 is placed on the common base 21 independently so as to be separated from the gear casing 3, and an oil gauge 71 (refer to FIG. 1) is attached to the oil tank 72. Since the oil tank 72 is separated from the driving system and has a freedom of being placed, it is possible to place the oil gauge 71 at an easily viewable position at a time of the maintenance.

Further, in the present embodiment, an intake duct 73 is provided in one side surface side of the unit, and an air inflow port 73*a* and an air outflow port 73*b* are respectively provided in a lower portion of an outer side of the intake duct 73 and in an upper portion of an inner side thereof, thereby introducing the ambient air to the inner side of the unit via the intake duct 73. In this case, the structure may be made such as to arrange at least one or all of the inter cooler (the low pressure stage cooling apparatus) 31, the after cooler (the high pressure stage cooling apparatus) 41, and the oil cooler (the lubricating oil cooling apparatus) 51 so as to be inclined with respect to the common base 21.

Further, in the present embodiment, the structure is made such that one end side of each of the coolers 31, 41 and 51 is fixed to the frame of the intake duct 73, thereby achieving a reduction of the number of the parts. Further, the structure is made such that a start plate 75 for starting the motor (the driving apparatus) 10 and a drier 76 for removing a water content in the compression gas are installed on the common base 21 within the package, the motor is arranged so as to be sandwiched between the start plate 75 and the drier 76, and the ambient air introduced into the package from one side surface of the package cools the motor at a time of passing through the portion between the start plate and the drier. In this case, reference numeral 74 denotes an intake filter filtering the air (the gas) sucked into the low pressure stage side compressor airend 1.

As mentioned above, in accordance with the present embodiment, it is possible to obtain the package type compressor unit which achieves the reduction of the parts number, the improvement of the working property and the workability, the reduction of the cost and the reduction of the noise.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A package type oil free screw compressor comprising:

a low pressure stage compressor airend;

a high pressure stage compressor airend;

a gear casing having a step-up gear;

a driving apparatus for driving each of said compressor main bodies via said step-up gear;

a low pressure stage cooling system apparatus cooling a compression gas discharged from the low pressure stage compressor airend;

a high pressure stage cooling apparatus cooling a compression gas discharged from the high pressure stage compressor airend;

a lubricating oil cooling apparatus cooling a lubricating oil lubricating said step-up gear; and a package in which said low pressure stage compressor airend, said high pressure stage compressor airend, said gear casing, said driving apparatus, said low pressure stage cooling system apparatus, said high pressure stage cooling apparatus and said lubricating oil cooling apparatus are packaged, wherein said low pressure stage compressor airend, said high pressure stage compressor airend and said driving apparatus are integrated, said driving apparatus is installed in a base common with a base installing the other devices, said low pressure stage cooling system apparatus, said high pressure stage cooling apparatus and said lubricating oil cooling apparatus are arranged in an upper portion of said package, an intake duct sucking an ambient air is arranged in one side surface of said package, and said intake duct physically supports at least one end of at least one of said low pressure stage cooling system apparatus, said high pressure stage cooling apparatus and said lubricating oil cooling apparatus arranged in an upper portion of the package.

2. A package type oil free screw compressor as claimed in claim 1, wherein an oil tank reserving a lubricating oil for lubricating the step-up gear within said gear casing is provided as an independent body from said gear casing, and said oil tank is installed on said base on which said driving apparatus is installed.

3. A package type oil free screw compressor as claimed in claim 1, wherein said low pressure stage cooling apparatus, the high pressure stage cooling apparatus and the lubricating oil cooling apparatus are arranged in the upper portion of said package, said low pressure stage cooling apparatus is arranged in an upper portion which is adjacent to said low pressure stage compressor airend, said high pressure stage cooling apparatus is arranged in an upper portion which is adjacent to said high pressure stage compressor airend, a cooling air cooling the low temperature side of said cooling apparatus comes to a lower temperature than a cooling air cooling the high temperature side, in at least any of said cooling apparatuses.

4. A package type oil free screw compressor as claimed in claim 3, wherein at least one of said low pressure stage cooling apparatus, the high pressure stage cooling apparatus and the lubricating oil cooling apparatus is arranged so as to be somewhat inclined with respect to said common base.

5. A package type oil free screw compressor as claimed in claim 1, wherein said intake duct is provided with an air inflow port formed in a lower portion of an outer side surface and communicating the ambient air with an inner side of the duct, and an air outflow port formed in an upper portion of an inner side surface of the duct, and introducing the air taken into the duct from said air inflow port into an inner side of the package, and said air inflow port and the air outflow port are arranged in such a manner as not to overlap in a horizontal direction.

6. A package type oil free screw compressor as claimed in claim 1, wherein a start plate for starting said driving apparatus, and a drier for removing a water content in the compression gas are installed on said base within said package, said driving apparatus is arranged so as to be sandwiched between said start plate and the drier, and the ambient air introduced into the package from one side surface of said package cools said driving apparatus at a time of passing through a portion between said start plate and the drier.

7. An oil free screw compressor as claimed in claim 1, wherein said gear casing is not directly fixed to said base.

8. A package type oil free screw compressor as claimed in claim 1, wherein said intake duct physically supports at least one end of each of said low pressure stage cooling system apparatus, said high pressure stage cooling apparatus and said lubricating oil cooling apparatus arranged in an upper portion of the package.

* * * * *